United States Patent [19]

Nishimura et al.

[11] Patent Number: 4,485,790

[45] Date of Patent: Dec. 4, 1984

[54] HOLDING CONSTRUCTION OF A FUEL INJECTION VALVE IN AN INTERNAL COMBUSTION ENGINE

[75] Inventors: Takaaki Nishimura, Mino; Hatsuo Takase, Kobe, both of Japan

[73] Assignee: Yanmar Diesel Engine Company Limited, Osaka, Japan

[21] Appl. No.: 425,977

[22] Filed: Sep. 28, 1982

[30] Foreign Application Priority Data

| | | | |
|---|---|---|---|
| Apr. 19, 1982 | [JP] | Japan | 57-65596 |
| Apr. 20, 1982 | [JP] | Japan | 57-57895[U] |
| Jun. 1, 1982 | [JP] | Japan | 57-94419 |

[51] Int. Cl.[3] ..... F02M 55/02

[52] U.S. Cl. ..... 123/468; 123/470

[58] Field of Search ..... 123/468, 469, 470, 471; 285/13, 14, 93

[56] References Cited

U.S. PATENT DOCUMENTS

| | | | |
|---|---|---|---|
| 3,125,078 | 3/1964 | Reiners | 123/468 |
| 3,431,895 | 3/1969 | Bailey | 123/470 |
| 3,845,748 | 11/1974 | Eisenberg | 123/468 |
| 3,924,583 | 12/1975 | Jardin | 123/470 |
| 4,384,557 | 5/1983 | Johnson | 123/468 |

FOREIGN PATENT DOCUMENTS

| | | | |
|---|---|---|---|
| 1245905 | 7/1960 | Fed. Rep. of Germany | 123/468 |
| 810963 | 9/1936 | France | 123/469 |

*Primary Examiner*—Magdalen Y. C. Moy

*Attorney, Agent, or Firm*—Armstrong, Nikaido, Marmelstein & Kubovcik

[57] ABSTRACT

A holding construction of a fuel injection valve in an internal combustion engine, wherein a fuel injection pipe connected to a fuel injection pump is laterally inserted from a cylinder head side face into a cylinder head, a laterally-disposed injection-pipe-connecting conical-receiving hole is formed on a fuel injection valve arranged in a central part of the cylinder head, and the tip end taper of the fuel injection pipe is directly connected to the receiving hole of the injection valve.

2 Claims, 5 Drawing Figures

HOLDING CONSTRUCTION OF A FUEL INJECTION VALVE IN AN INTERNAL COMBUSTION ENGINE

BACKGROUND OF THE INVENTION

This invention relates mainly to a holding construction of a fuel injection valve in a Diesel engine.

Such a construction, that high-pressure fuel oil is passed from a cylinder head side face 61*a* into a cylinder head 61 to be supplied to a fuel injection valve 62, is frequently used in recent Diesel engines as shown in FIG. 5. This construction makes it possible to avoid distribution of an injection pipe 65 (in which high-pressure fuel oil is passed) into a valve rocker arm chamber 63 having a limited space, and simultaneously to avoid leakage of fuel oil into the valve rocker arm chamber 63 by connecting the injection pipe 65 to the upper end of the injection valve 62.

In the conventional art as shown in FIG. 5, however, an intermediate joint 66 is connected to the injection valve 62, the intermediate joint 66 is extended to the cylinder head side face 61*a*, and the fuel injection pipe 65 is connected to the intermediate joint 66. Therefore, when detaching the injection valve, the detaching work becomes troublesome because it is required to disconnect the two connections; i.e. the connection between the injection pipe 65 and the intermediate joint 66 and the connection between the intermediate joint 66 and the injection valve 62. Further, danger of fuel oil leakage may be increased due to two connections provided.

An object of this invention is to make the detaching work of the injection valve easy. Another object of this invention is to make a piping work of the injection pipe easy. A further object of this invention is to prevent high-pressure fuel oil from leaking.

In order to accomplish the above objects, in this invention a fuel injection pipe connected to a fuel injection pump is inserted laterally from a cylinder head side face into a cylinder head, a laterally disposed conical receiving hole for connecting the fuel injection pipe is formed on a fuel injection valve which is disposed in a central part of the cylinder head, and a tip end taper of the fuel injection pipe is directly connected to the receiving hole of the injection valve.

DETAILED DESCRIPTION OF THE INVENTION

Figure 1:
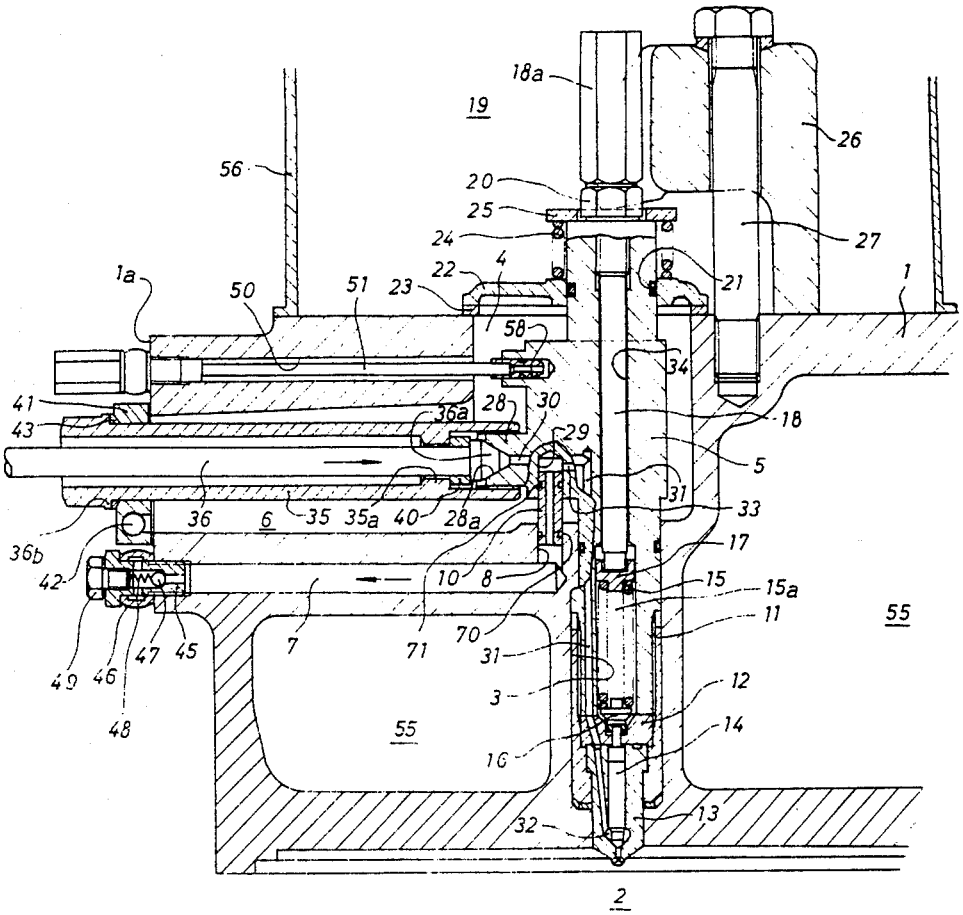
FIG. 1 is a vertical sectional view of a cylinder head of an internal combustion engine is accordance with this invention.

FIG. 1 shows a cylinder head of Diesel engine equipped with the construction of this invention. In FIG. 1, a fuel injection valve inserting hole 3 opening to a combustion chamber 2 is formed at a lower half portion of a cylinder head 1, and a fuel injection valve chamber 4 connected to the inserting hole 3 is formed at an upper part of the inserting hole 3. The injection valve chamber 4 has a large volume incorporating a fuel injection valve 5 with a sufficient allowance, being formed with its upper side opened. A laterally disposed injection pipe incorporating (inserting) chamber 6 extending to a cylinder head side face 1*a* interconnects to the valve chamber 4. A leaking oil passage 7, which extends laterally from the cylinder head side face 1*a* to a lower part of the valve chamber 4, is formed at a lower part of the incorporating chamber 6, and an upwardly opening leaking oil inlet port (leaking oil inlet portion) 8 extending upward is formed at the valve chamber 4 side end of the leaking oil passage 7.

A vertically disposed connector 10 is inserted in and connected to the inlet port 8.

A nozzle body 13 is fixed to the bottom end of the fuel injection valve 5 through a spacer 12 by means of a nozzle tightening nut 11, a lower half of the injection valve 5 and the nozzle body 13 are inserted into the inserting hole 3 from the upper side, and the bottom tip end of the nozzle body projects into the combustion chamber 2. A needle valve 14 in the nozzle body 13 is depressed downward by a coil spring 15 through a lower spring seat 16, and an upper end of the coil spring 15 is joined through an upper spring seat 17 to an injection quantity control rod 18. An upper end of the rod 18 is screwed into an upper end internal thread of the injection valve 5, being provided with a long head 18*a* projecting into a valve rocker arm chamber 19. The rod 18 is locked at an appropriate vertical position with a lock nut 20.

A valve chamber cover 22 fits onto the upper end of the injection valve 5 through an O-ring 21, an annular holder plate 25 contacts on a top surface of the injection valve 5, a coil spring 24 is provided between the holder plate 25 and the cover 22, and the holder plate 25 is depressed downward by means of a fuel injection valve holder metal 26. Namely, the holder metal 26 and the holder plate 25 depress the injection valve 5 downward, and simultaneously depress the valve chamber cover 22 downward through the coil spring 24. 23 is a packing. The holder metal 26 is fixed onto an upper surface of the cylinder head 1 with a bolt 27, and a tip end portion of the holder metal 26 (the left end side of the metal in FIG. 1) is formed into a forked shape so that the long head 18*a* is inserted therein.

An external thread (connecting portion to injection pipe) 28 directing to the injection pipe incorporating chamber 6 and a downward opening leaking oil outlet port (leaking-oil passage-connecting-part) 29 are formed in a valve chamber of the injection valve 5, and the outlet port 29 is fitted on and connected to the connector 10. A fuel oil passage 30 in the external thread 28 interconnects with an annular passage 32 of the nozzle body through a passage 31 in the injection valve 5. The outlet port 29 interconnects to the space between an outer peripheral surface of the rod 18 and an inner peripheral surface of a rod inserting hole 34 through a passage 33. The outlet port 29 is formed behind the plane of FIG. 1 as compared with the external thread 28 so that the both 28 and 29 do not overlap one another on the same plane (on the plane of FIG. 1).

A tightening tube 35 is inserted in the incorporating chamber 6, a fuel injection pipe 36 is inserted in the tightening tube 35, and an injection pipe tip end taper 36*a* is depressed against a conical receiving hole 28*a* of the external thread 28 through an inward flange 35*a* and an O-ring 40 by screwing the tightening tube 35 to the external thread 28. An outward flange 36*b* is formed at the left end of the tightening tube 35 in FIG. 1, and a packing 43 is depressed against an incorporating chamber side cover 41 by the outward flange 36*b*. The incorporating chamber side cover 41 is depressed against the cylinder head side face 1*a* by a bolt. A drain hole 42 interconnecting to the incorporating chamber 6 is formed at the bottom part of the side cover 41, and the drain hole 42 is interconnected to a drain tank. The fuel injection pipe 36 is connected to a fuel injection pump.

A check valve body 45 is screwed to a cylinder head face side of the leaking oil passage 7, a return pipe 46 is connected to the check valve body 45, and the return pipe 46 is interconnected to a fuel tank. The check valve body 45 is provided with a check valve mechanism comprising a ball 47, a valve spring 48 and a spring holder screw 49, and is so designed as to permit oil to flow only from the leaking oil passage 7 to the return pipe 46.

In FIG. 1, 55 is a cooling water jacket and 56 is a valve rocker arm chamber cover. 70 and 71 are O-rings fitted to lower and upper parts of the connector 10 respectively. The valve rocker arm chamber 19 is filled with atmosphere of lubricating oil.

In the case where a cooled nozzle (not shown in the figure) is used, a cooling oil pipe inserting hole 50, which passes from the injection valve chamber 4 to the cylinder head side face 1*a*, is formed at an upper part of the incorporating chamber 6, a cooling oil pipe 51 inserted into the inserting hole 50 is fitted in and connected to a valve chamber inside of the injection valve 5 to be interconnected with a cooling oil passage (not shown in the figure) in the injection valve 5.

Fuel oil supplied from the fuel injection pump to the injection pipe 36 is sent through the passages 30 and 31 to the annular passage 32, being injected through the tip end of the needle valve 14 into the combustion chamber.

Fuel oil (leaking oil) leaking into the injection valve inside such as a spring chamber 15*a* passes in between the rod 18 and the rod inserting hole 34, through the passage 33, the outlet hole 29, the connector 10, and the hole 8 into the leaking oil passage 7, enters the return pipe 46 through the ball 47 in the check valve body 45, thus returning to the fuel tank.

In the event when fuel leaks from the external thread 28 or the outlet port 29, the leaking oil flows from the valve chamber 4 through the incorporating chamber 6 into the drain hole 42, thus being sent to the drain tank. Namely, the fuel does not flow into the valve rocker arm chamber 19. Also in the event when cooling oil leaks from the connecting portion of a cooling oil pipe 51 and the injection valve 5, the leaking cooling oil flows into the drain hole 42 and not into the valve rocker arm chamber 19.

In order to attach the injection valve 5, the connector 10 should be pressed into the leaking oil outlet port 29 previously, then a valve unit comprising such as the injection valve 5 and nozzle body 13 etc. should be put in the valve chamber 4 from the upper side and simultaneously the lower half of it should be inserted into the inserting hole 3. The inlet port 8 and the outlet port 29 are fitted and connected together through the means of the connector 10 at this moment. The injection valve 5 is simultaneously positioned around the center axis with the above procedure. Then, the valve chamber cover 22 should be fitted in the injection valve 5, the spring 24 and the holder plate 25 should be equipped therein, and the injection valve 5 should be depressed downward with the holder metal 26 and the cover 22 should be depressed through the spring 24 simultaneously.

The injection pipe 36 is inserted into the incorporating chamber 6 from the cylinder head side face 1*a* together with the tightening tube 35, and the tip end taper 36*a* is directly connected to the conical receiving port 28*a* of the injection valve 5 by screwing the tightening tube 35 onto the external thread 28.

The cooling oil pipe 51 is inserted into the inserting hole 50 from the cylinder head side face 1*a*, and fitted in and connected to a receiving hole 58. A cylinder head side portion of the cooling oil pipe 51 is screwed into the internal thread of the hole 50. When dismantling the injection valve 5, it is enough to perform the dismantling work in the reverse order of the above. With respect to the fuel injection pipe 36, it is only required to disconnect the taper 36*a* from the receiving port 28*a* by removing the tightening tube 35 from the external thread 28.

In accordance with the embodiment as shown in FIG. 1, the following advantages are obtainable in addition to the above objects of this invention:

(1) Even when oil leaks from connecting portions such as the external thread 28 and outlet port 29, fuel oil does not leak into the valve rocker arm chamber 19 because the injection pipe 36 and the leaking oil passage 7 are connected to the injection valve 5 in the valve chamber 4, and the valve chamber 4 is isolated from the valve rocker arm chamber 19 by means of the valve chamber cover 22. Accordingly, there are no apprehensions that the atmosphere of lubricating oil in the valve rocker arm chamber 19 is diluted with the abovementioned fuel oil etc. and that lubricating function is affected adversely. Namely, engine sticking etc. can be prevented securely.

(2) Since the valve chamber 4 has a large volume for incorporating the injection valve 5 with a sufficient allowance, even the injection valve 5 having the external thread additionally can be incorporated in the valve chamber 4 easily. Therefore, the attaching work of the injection valve 5 becomes easy.

(3) Since the valve chamber 4 has a large volume for incorporating the injection valve 5 with a sufficient allowance and is formed into the upwardly opening shape, the connected parts such as the external thread 28 can be inspected by removing the valve chamber cover 22. Namely, the connected parts can be inspected without removing the injection pipe 36.

(4) Since the valve chamber 4 has a large volume, it becomes possible to accomplish light-weight of the cylinder head 1.

(5) The leaking oil passage 7 is connected to the injection valve 5 by connecting the upwardly opening leaking oil inlet port 8 through the connector 10 to the downwardly opening outlet port 29, so that the leaking oil passage 7 can be easily connected to the injection valve 5 by only inserting the injection valve 5 into the valve chamber 4 from above.

(6) Since the leaking oil passage 7 is connected to the upward-extending upwardly opening leaking oil inlet port 8 and to the check valve (body 45 etc.), fuel in the leaking oil passage 7 does not flow out into the valve chamber, the injection valve inserting hole 4, or further to the combustion chamber 2 when disassembling the injection valve 5.

(7) It is not necessary to disassemble leaking oil related parts such as the connector 10 etc. when taking out the injection valve 5.

Figure 2:
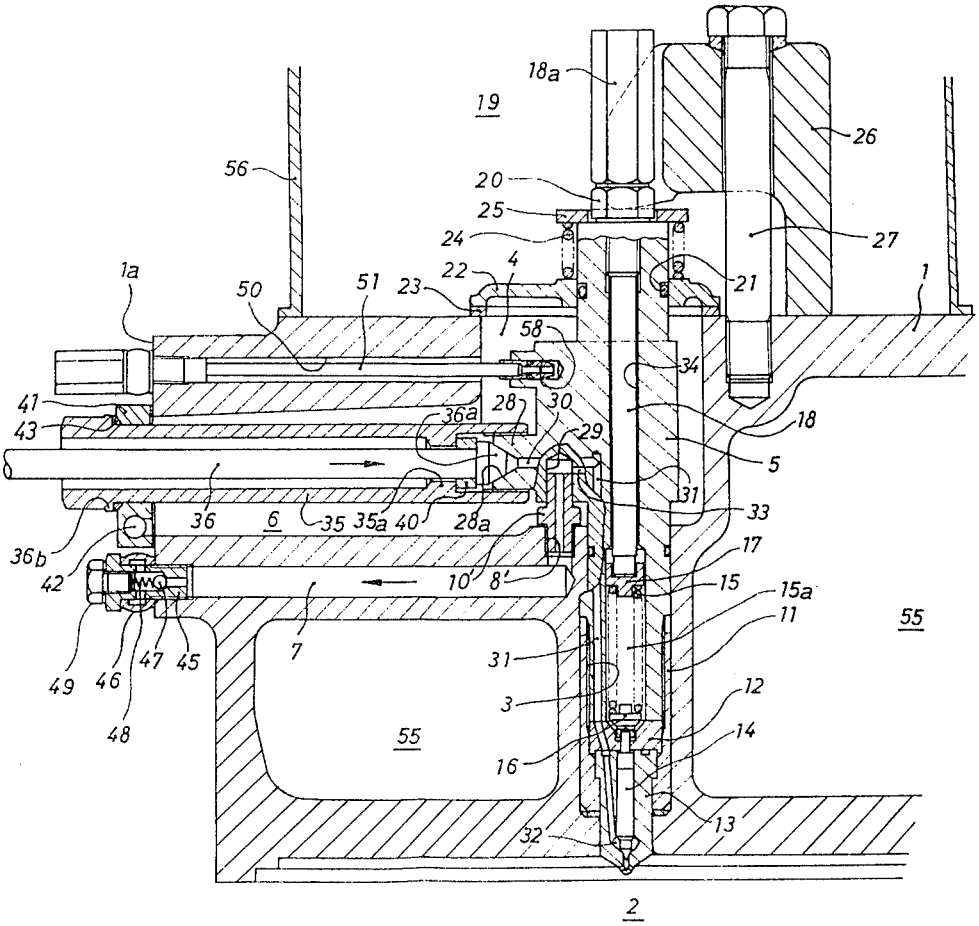
FIGS. 2, 3, and 4 are vertical sectional views showing another embodiments respectively.

FIG. 2 shows a second embodiment, in which an upward-extending internal thread hole (leaking oil inlet port) 8′ interconnects to the valve chamber 4 side end of the leaking oil passage 7, and a connector 10′ projecting upward into the valve chamber 4 is screwed into the internal thread hole 8′. In this figure, a component corresponding to FIG. 1 is marked with the same number as that in FIG. 1.

Figure 3:
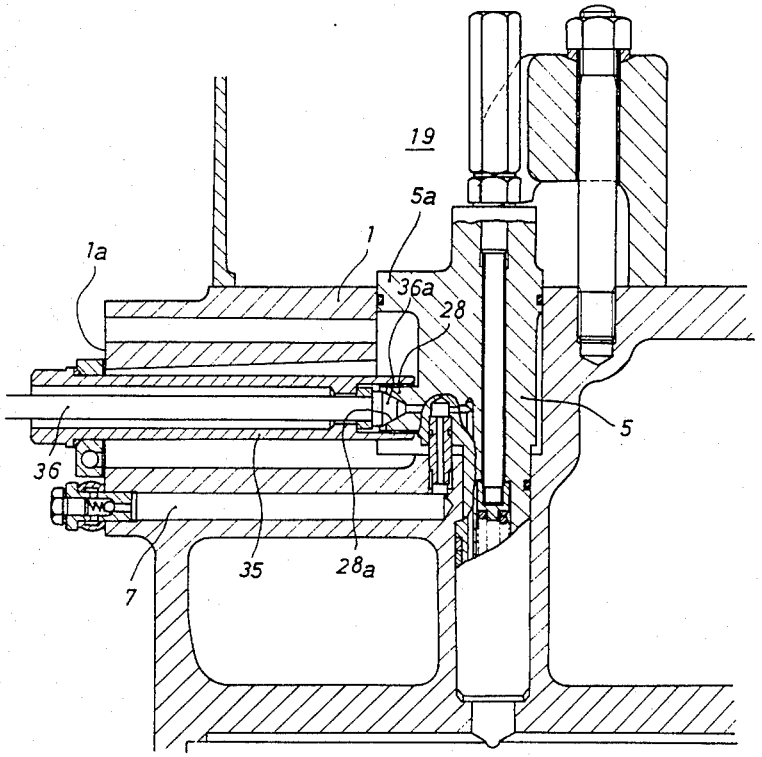

FIG. 3 shows a third embodiment which is applied to a fuel injection valve 5 of a deformed cylindrical shape. The injection valve 5 shown in FIG. 3 is provided with a valve chamber cover 5*a* integrally. A component corresponding to FIG. 1 is marked with the same number as that in FIG. 1. In the construction shown by FIG. 3, it is not necessary to provide a valve chamber cover additionally, fewer components being required as compared with that of FIG. 1.

Figure 4:
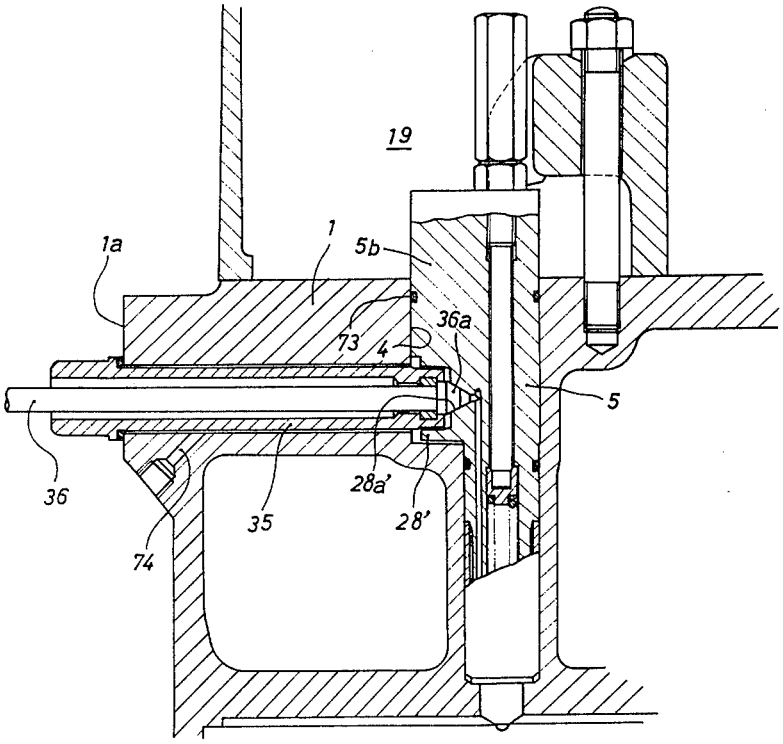
Figure 5:
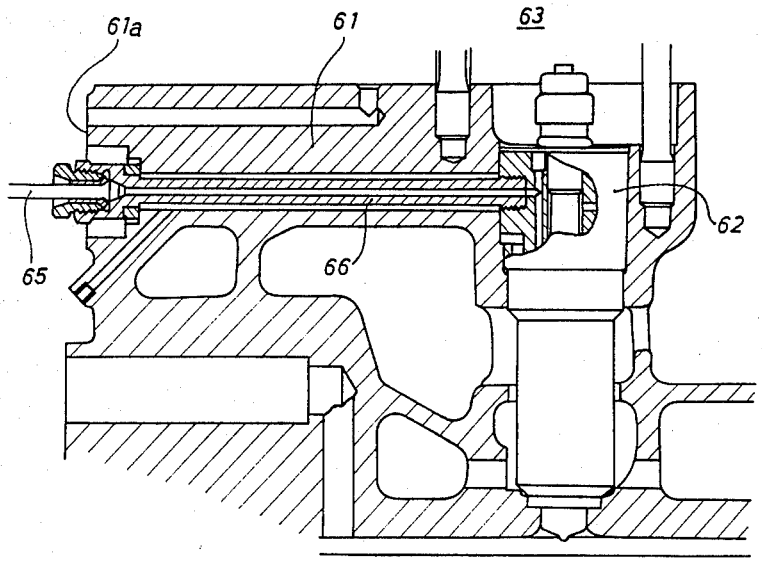
PRIOR ART FIG.5
FIG. 5 is a vertical sectional view of a conventional structure of the prior art.

FIG. 4 shows a fourth embodiment which is applied to a fuel injection valve 5 of an eccentric cylindrical shape. In the injection valve shown by FIG. 4, an enlarged eccentric cylindrical part 5*b* fits in an inner peripheral surface of a valve chamber 4 through an O-ring 73. An external thread is formed on the cylinder head side end of the tightening tube 35, and screwed into a laterally disposed internal thread 28′ of the injection valve 5. 28*a*′ is a conical receiving hole for connecting injection pipe, and 74 is a drain passage. Also in this figure, a component corresponding to FIG. 1 is marked with the same number as that in FIG. 1.

As mentioned above, in this invention the fuel injection pipe 36 connected to the fuel injection pump is inserted laterally from the cylinder head side face 1*a* into the cylinder head 1, the laterally-disposed fuel-injection-pipe-connecting conical-receiving hole 28*a* (28*a*′) is formed on the injection valve 5 arranged in a central part of the cylinder head 1, and the tip end taper 36*a* of the fuel injection pipe 36 is directly connected to the receiving hole 28*a*. Consequently, the following advantages are obtainable:

(1) Since the injection pipe 36 is directly connected to the injection valve 5 without using an intermediate joint 66, the injection pipe 36 can be detached from the injection valve 5 by disconnecting only one connection when taking out the injection valve, thus the detaching work of the injection valve 5 becomes easy. Naturally, the attaching work of the injection valve becomes easy.

(2) Since the injection pipe 36 is not required to be distributed in the valve rocker arm chamber 19 which is limited in space, the piping work of the injection pipe 36 becomes easy.

(3) Since the intermediate joint is not used between the injection pipe 36 and the injection valve 5, danger of leaking out of high-pressure fuel oil can be reduced remarkably.

(4) Since the injection pipe 36 is connected to the injection valve 5 passing through the cylinder head 1, the connected part can be easily isolated from the valve rocker arm chamber 19, and high-pressure fuel oil does not flow out into the valve rocker arm chamber 19 even when it leaks from the connected part. Accordingly, the possibility is eliminated for the lubricating oil atmosphere in the valve rocker arm chamber 19 to be diluted by the abovementioned fuel oil, i.e. the possibility, that lubricating function is affected adversely, is eliminated.

What is claimed is:

1. A fuel injection valve construction for an internal combustion engine having a cylinder head, comprising:

a fuel injection valve arranged in a valve chamber in a central part of said cylinder head, said valve being formed with a laterally extending connecting portion having a conical receiving hole therein and an external thread formed thereon around said conical receiving hole;

a fuel injection pipe formed at its tip end with a conical taper to fit said conical receiving hole and having an outwardly extending annular flange;

a tightening tube surrounding said fuel injection pipe and having formed at its end an inwardly projecting flange and an internal thread fitting with said external thread;

said fuel injection pipe and said tightening tube being laterally inserted from a side face of said cylinder head and being connected to said connecting portion by tightening said tightening tube internal thread on said connecting portion external thread to directly connect said conical taper of said fuel injection pipe with said conical receiving hole of said fuel injection valve;

a leaking oil passage formed in said cylinder head and connected to a fuel-tank-side return pipe through a check valve;

an upwardly extending upwardly opening leaking oil inlet port formed in said cylinder head between said leaking oil passage and said valve chamber;

a downwardly opening leaking oil outlet port formed as a leaking-oil-passage-connecting part on said injection valve; and a vertically disposed connector in said valve chamber connecting said leaking oil outlet port to said leaking oil inlet port.

2. A fuel injection valve construction as claimed in claim 1, wherein said fuel injection valve is formed into a deformed cylindrical shape, and a valve chamber cover for isolating said valve chamber is formed integrally with said fuel injection valve as an enlargement of the upper portion of said fuel injection valve shaped to tightly fit the interior of said valve chamber.

* * * * *